United States Patent [19]

Taylor et al.

[11] Patent Number: 5,065,673

[45] Date of Patent: Nov. 19, 1991

[54] CROSS-DIRECTIONAL MOISTURE CONTROL SYSTEM AND METHOD

[75] Inventors: Bruce S. Taylor, San Jose; Ramesh Balakrishnan, Stanford, both of Calif.

[73] Assignee: Measurex Corporation, Cupertino, Calif.

[21] Appl. No.: 409,628

[22] Filed: Sep. 19, 1989

[51] Int. Cl.[5] ..... B30B 13/00; D21G 1/00

[52] U.S. Cl. ..... 100/40; 100/35; 100/74; 100/162 R

[58] Field of Search ..... 100/71, 73–75, 100/40, 35, 162 R

[56] References Cited

U.S. PATENT DOCUMENTS 4,370,923 2/1983 Schmidt ..... 100/74 x 4,642,164 2/1987 Hanhikoski et al. ..... 100/74 X

FOREIGN PATENT DOCUMENTS 570261 2/1959 Canada ..... 100/74

*Primary Examiner*—Harvey C. Hornsby

*Assistant Examiner*—Stephen F. Gerrity

*Attorney, Agent, or Firm*—Spensley Horn Jubas & Lubitz

[57] ABSTRACT

A moisture control system including an apparatus for discharging independently variable amounts of working fluid toward selected cross-directional sections of a calendered sheet material after the material has left the calender stack and before it is taken up by a collection device. The apparatus includes a plurality of valves spaced across the width of the calendered material to control the amount of fluid applied to each section. Nozzles provided on the valves direct the fluid from the valves toward a surface of the calenderable material. The system permits cross-directional equalization of the moisture content of the calendered material without affecting other physical properties of the sheet, such as sheet finish.

22 Claims, 4 Drawing Sheets

10
12
14
16
18
20
22
24
26
28
72
78
80
VALVE CONTROL

CROSS-DIRECTIONAL MOISTURE CONTROL SYSTEM AND METHOD

BACKGROUND OF THE INVENTION

1. Field of the Invention

The present invention relates primarily to the field of calendering sheet material and more particularly to a system and method for improving the quality of a calendered paper sheet or the like.

2. Related Art

Paper quality is frequently measured by its printability and its runability. Printability of a paper sheet refers to the quality of image transfer to the sheet during the printing process and may be influenced by the sheet's finish (e.g., the degree of its gloss and/or smoothness). Runability, on the other hand, refers to the ability of the paper sheet to progress smoothly through the machinery of the printing process (i.e., paper having good runability will not tear or wrinkle during printing). The runability of the paper sheet is influenced by the cross-directional uniformity of sheet characteristics such as its caliper (thickness), strength and moisture content.

Paper production typically involves a calendering process which includes pressing paper material between calender rolls to obtain desired physical characteristics. Calendering paper can change its density, thickness, and surface characteristics (e.g., gloss and smoothness). Heat and moisture (usually in the form of steam) are frequently applied to paper being calendered to affect certain of its characteristics. Various grades of paper may thus be produced to suit various applications.

One of the parameters used in grading paper sheets is the finish of the sheet's surface. Typically, bulk paper is produced in a continuous sheet and wound in rolls having dimensions 12 to 36 feet in the cross-direction (i.e., across the width of the sheet). Cross-directional uniformity of surface finish of the bulk roll (i.e., across its width) is often desirable or necessary. For example, in the situation where the roll of paper is cut to size for making various paper products, the consistency of the finish of the individual paper items is dependent upon the uniformity of the finish of the original bulk paper roll.

The desired finish of a highly finished paper sheet is typically created by calendering the paper on a "supercalender" consisting of a stack of alternating hard polished steel rolls and soft or resilient cotton rolls. For example, a glossier finish may be created on the surface of paper by applying steam to the paper surface before or during supercalendering. The steam condenses on the paper surface and its surface fibers (or coating) are softened as the paper sheet travels through the calender stack. As the steam treated paper surface comes into contact with the calender rolls, it is smoothed by the pressing and rubbing actions of the polished steel roll and adjacent cooperating soft roll and a glossy finish is created. The degree of gloss created is dependent on the amount of moisture and heat and hence the amount of steam applied to the surface. A common problem encountered in creating a desired finish during calendering is the cross-directional non-uniformity of the finish obtained. Cross-directional variations in the contact load between adjacent rolls and other factors affect the uniformity of the finish profile created on the calendered sheet. To address this problem, steam application devices which independently vary the amount of steam directed at various cross-directional sections of the sheet may be provided on the calender stack. Unfortunately, adjustments made to the surface finish profile of the paper sheet during calendering using steam typically degrade the cross-directional uniformity of the moisture content of the finished sheet. For example, sectionalized steam application for creation of a uniform gloss profile typically creates a 0.5% moisture variation in the profile of 30 to 70 Lb/3300 Ft.$^2$ finished sheet. Supercalendered sheets typically contain only approximately 4% moisture. Accordingly, a 0.5% cross-directional variation can be quite significant.

A non-uniform moisture profile of the sheet, in turn, has a negative affect on the runability of the paper sheet. Specifically, variations in the moisture profile of the paper sheet may create areas of stress concentration. Such areas are prone to tearing during the printing process. A non-uniform moisture profile may also have a somewhat negative affect on the printability of the paper sheet and may cause the paper sheet to curl and wrinkle when it is removed from its bulk roll.

Steam treatment during calendering thus has "coupled" negative and positive affects on paper quality, i.e., an improvement in cross-directional finish uniformity may be coupled to a loss of runability and printability.

SUMMARY OF THE INVENTION

The present invention is directed towards a system and method for equalizing the moisture content on a calendered sheet material. The system includes an apparatus for discharging variable amounts of a working fluid, such as, for example, steam or atomize water, toward the surface of a calendered sheet material, such as paper, to effect a uniform moisture content of the material. The invention "decouples" moisture control from finish control by providing an apparatus which can direct variable amounts of working fluid toward one or more sections of the surface of the sheet material after the sheet material has left the calender stack and, therefore, after the material's desired finish profile has been achieved. The invention can provide simple, efficient and precise cross-directional control over the amounts of working fluid directed toward the various sections of the calendered material by means of flow control valves and associated nozzles spaced in the cross-direction of the material.

In a preferred embodiment, the working fluid is steam and the fluid discharge apparatus of the present invention comprises a steam manifold positioned adjacent to a sheet of material at a location after the sheet has left the calender stack, and before it is collected on a collection device such as, for example, a reel. The steam manifold substantially spans the width of the calendered sheet of material (i.e., its cross-direction). Spaced along the side of the steam manifold facing the calendered sheet of material are a plurality of control valves, each valve being provided with a spray nozzle through which steam is discharged. Steam is supplied to the valves by the steam manifold. The amount of steam discharged through each spray nozzle is controlled by its corresponding valve.

The steam manifold is preferably disposed below the calendered sheet of material. The steam discharged from the spray nozzles is thus directed upwardly. Furthermore, the steam manifold is preferably disposed a sufficient distance below the sheet of material to allow the steam to condense before reaching the sheet's surface. With this arrangement, the moisture reaching the sheet does not significantly affect the sheet's temperature since the heat of condensation is dispersed to the atmosphere rather than being absorbed by the sheet. It is desirable to avoid affecting the temperature profile of the sheet because variations in temperature may cause the sheet to unevenly stretch or shrink as it is collected by the collection device. This arrangement additionally allows removal of large, and therefore less buoyant, condensate droplets potentially present in the vapor. Such droplets are thus prevented from reaching the sheet and uncontrolled, localized variations in the amount of moisture applied to a given section of the sheet of calendered material are avoided. In addition, vapor generated by "just" condensed steam is very uniform, and as such will provide uniform coverage and minimize the risking of spotting or marking the sheet. By controlling the amount of steam passing through each of the valves, and thereby the amount of steam discharged by each spray nozzle, the moisture distribution along and across the calendered material may be controlled.

The moisture profile of the calendered sheet of material may be monitored using a conventional sheet moisture sensor (e.g., an infrared moisture sensor), and the moisture distribution may be adjusted as needed. The moisture sensor monitors the moisture profile of the calendered material at intervals in the cross-direction of the sheet and generates signals corresponding to the measured moisture. The signals from the sensor are then provided to a control device, such as the paper mill process control computer, which adjusts the volume of steam discharged through each spray nozzle by its respective valve. The amount of moisture discharged toward each section of the surface of the calenderable material in the cross-direction is thereby controlled to achieve a desired moisture profile across the length and width of the sheet. Typically, a uniform moisture profile will be desired, however, intentionally non-uniform moisture profiles may also be created with this invention.

BRIEF DESCRIPTION OF THE DRAWINGS

Like reference characters in the various drawings refer to like elements.

DETAILED DESCRIPTION OF THF PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 1:
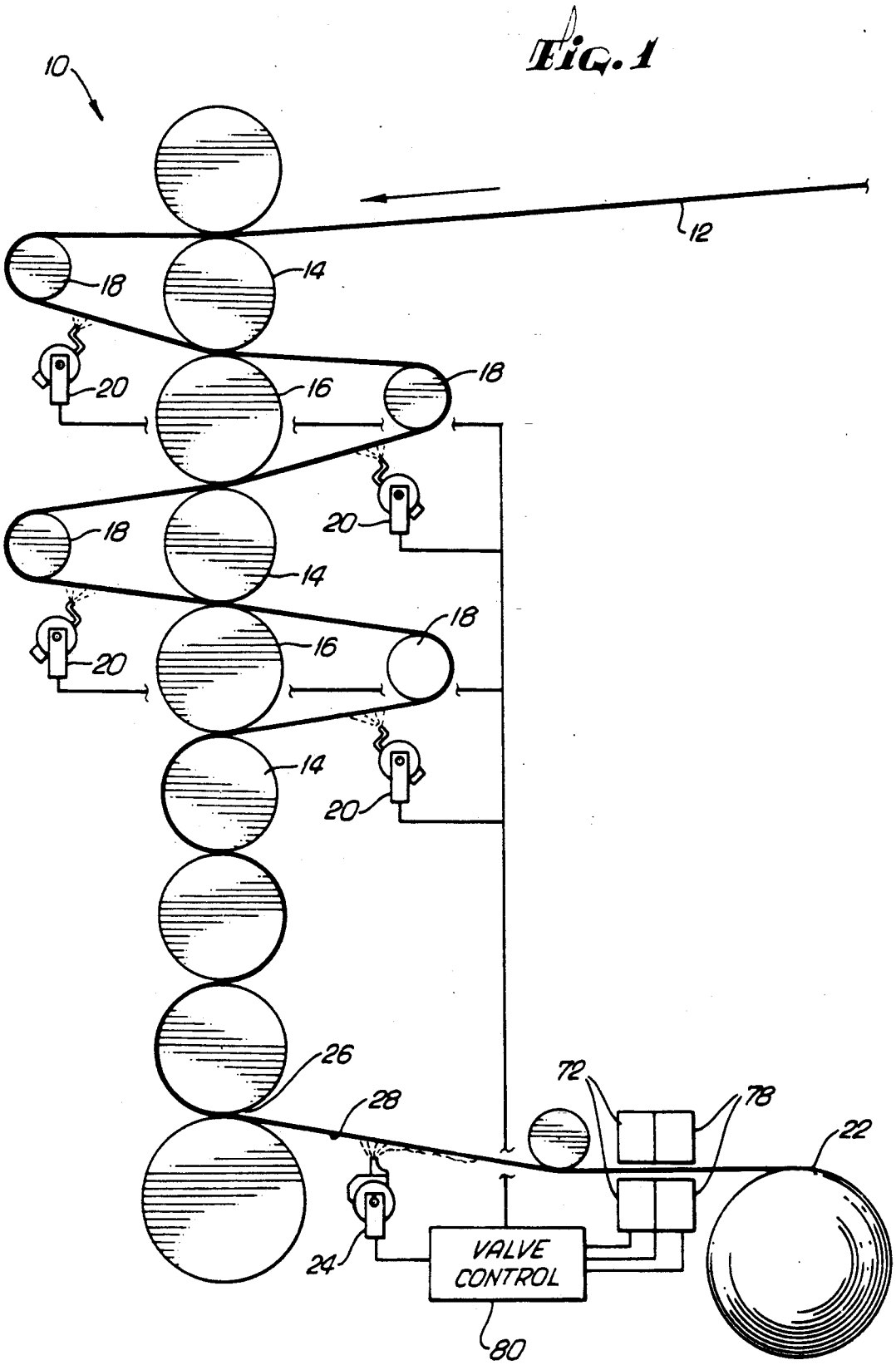
FIG. 1 shows a side plan view of a calender stack and collection reel arrangement with which the present invention may be utilized.

FIG. 1 shows an example of a process in which the present invention may be applied. FIG. 1 illustrates a calender stack 10 suitable for pressing a sheet of calenderable material, such as paper 12, to obtain desired physical characteristics of the calendered material. For convenience, the invention will be described hereafter with reference to paper as the calenderable material. However, the invention is applicable to other sheet materials. The supercalender calender stack 10 typically includes alternating highly polished hard rolls 14 and softer rolls 16 having somewhat resilient surfaces. The rolls 14, 16 are typically arranged in a vertical stack wherein the paper passes between the rolls in a path of a general "S" configuration. Idler rolls 18 are typically provided on the sides of the stack to facilitate the wrinkle-free movement of the paper.

Steam showers 20 are typically provided at various locations along the calender stack to apply steam to one or both surfaces of the paper sheet 12 as it is calendered. Certain characteristics of the paper such as its surface gloss and smoothness may thereby be controlled. After the paper sheet 12 leaves the calendered stack 10, it is collected on a collection reel 22. A fluid discharge apparatus 24 of the present invention is positioned adjacent the paper sheet 12 at a location downstream of the last nip 26 of the calender stack (the point where the last two rolls of the calender stack meet) and upstream of the collection device 22 (typically a reel), with reference to the direction of travel of the paper sheet 12. The fluid discharge apparatus 24 is preferably disposed below the paper sheet 12 and directs working fluid upwardly, toward its surface 28.

In a preferred embodiment of the invention, the working fluid comprises saturated steam and the fluid discharge apparatus 24 is preferably positioned approximately 4 to 6 inches below the surface 28 of the paper sheet 12. Steam is emitted from the fluid discharge apparatus 24 at a low velocity and begins to condense in the air, thereby forming a highly uniform mist of condensed water vapor, prior to contacting the surface 28 of the paper sheet 12. As previously mentioned, it is desirable that steam be allowed to condense prior to contacting the sheet to avoid creation of variations in the temperature profile of the sheet. Uneven shrinkage or stretching of the sheet during or after collection is thereby avoided.

For convenience, the invention will be described hereafter with reference to steam as the working fluid. However, other fluids may serve as the working fluid. For example, a low velocity atomized water spray may be utlized as described in greater detail below.

Figure 2:
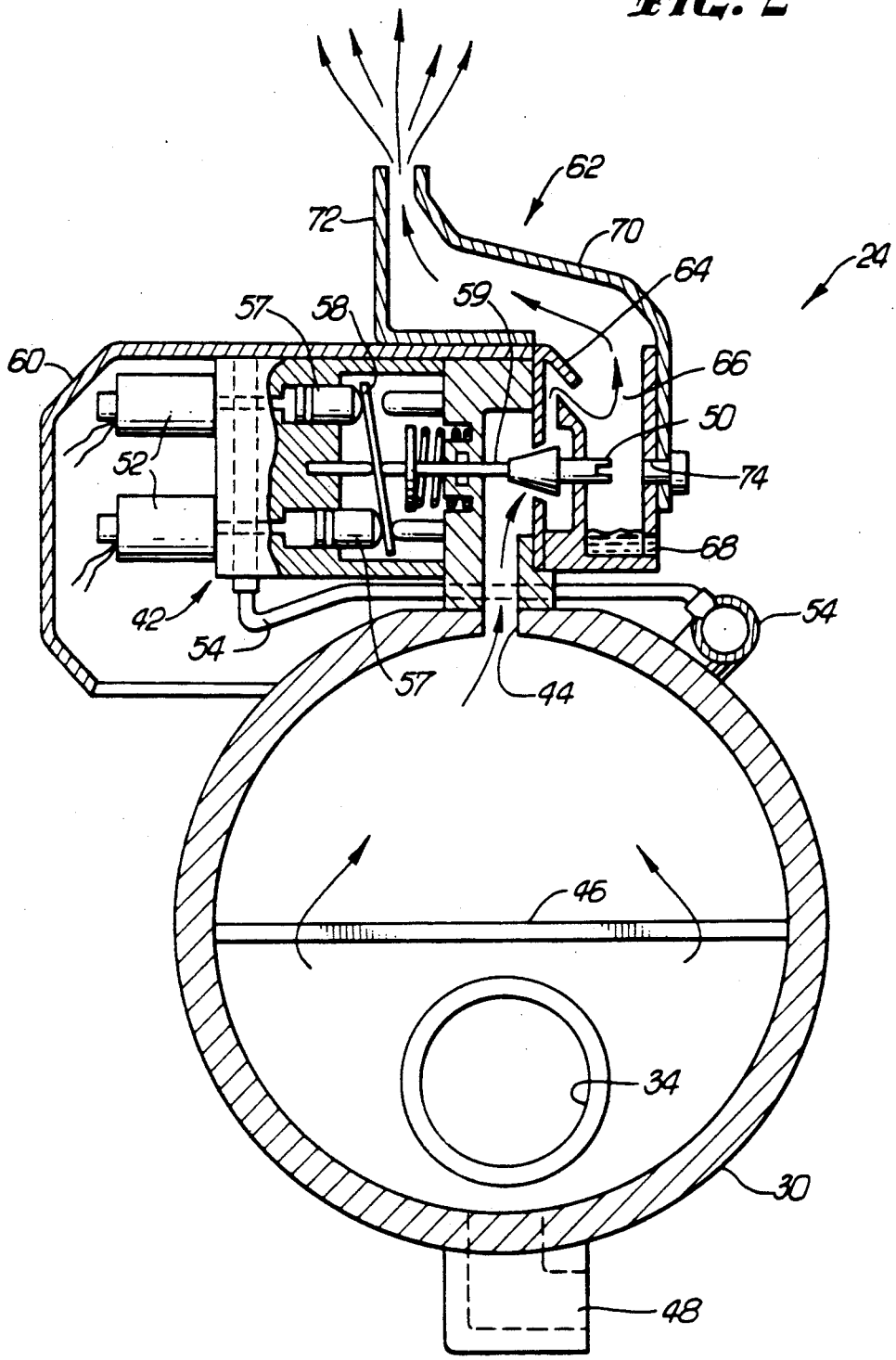
FIG. 2 shows a cross-sectional view of an embodiment of the present invention.

The structure of a preferred embodiment of the fluid discharge apparatus 24 of the present invention is described with reference to FIGS. 2, 3 and 4. FIG. 2 is a cross-sectional view of an embodiment of the fluid discharge apparatus 24. In the illustrated embodiment, the fluid discharge apparatus 24 comprises a steam manifold preferably fabricated from a pipe 30 having a length generally spanning the width of the sheet of paper to which steam will be applied (i.e., in the cross-direction). Different paper manufacturers manufacture sheets of paper of differing widths, ranging generally from 12 to 36 feet. Accordingly, the length of the pipe 30 will vary. The pipe 30 preferably has a diameter of approximately six inches and is preferably made from corrosion-resistant material such as, for example, stainless steel or aluminum. It has been determined that a six-inch diameter pipe is readily available at relatively low cost, and thus offers a major benefit over more complex and costly fluid distribution systems.

Figure 3:
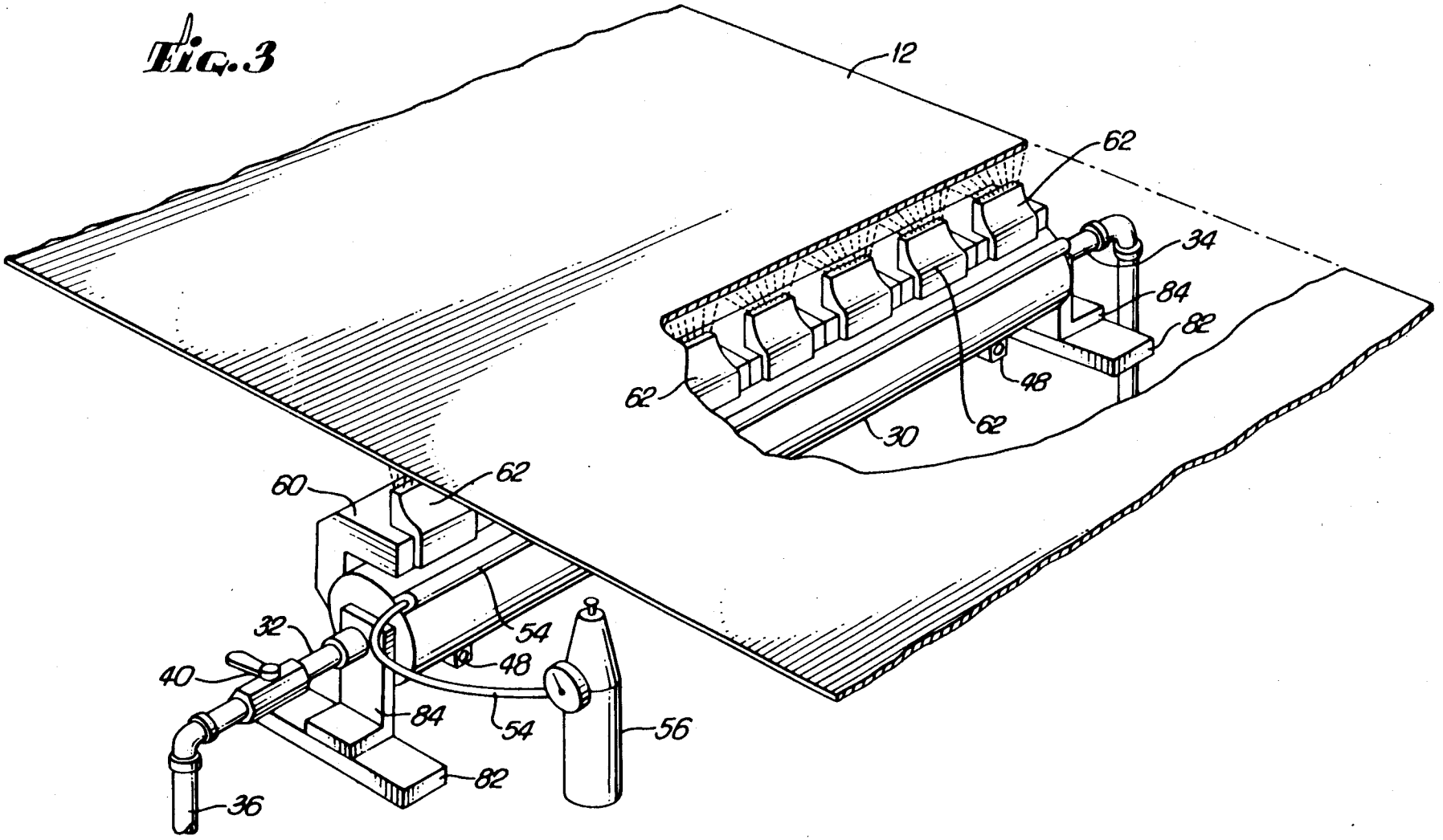
FIG. 3 shows a perspective view of the inventive fluid discharge apparatus.

As is shown in FIG. 3, the steam pipe 30 is provided with an inlet pipe 32 at one end and an outlet pipe 34 at its opposite end. Suitable inlet and outlet pipes 32 and 34 have a diameter which is smaller than the diameter of the steam manifold pipe 30 (for example, two inches) Steam, preferably in a saturated state at 1–15 psig pressure, is delivered into the inlet pipe 32 by a main supply pipe 36. The inlet pipe 32 may be provided with a pressure control valve 40 and a pressure sensor (not shown). Steam will enter the steam pipe 30 only if the pressure control valve 40 is at least partially open. With this arrangement, if a plurality of steam showers 20 are provided in addition to the fluid discharge apparatus 24 of the present invention, the fluid discharge apparatus 24 may receive steam from the same steam source as the steam showers 20 yet be operated independently of the steam showers 20. Furthermore, since the steam pressure valve 40 allows control over the volume of steam entering the steam pipe 30, the average amount of steam applied by the fluid discharge apparatus 24 across the width of the sheet 12 may thus be regulated to provide machine direction control of the average moisture content if desired. In this situation, the valve 40 may be automatically controlled by a valve control device operated under computer control.

A plurality of flow control valves 42 are mounted to the top of the steam manifold pipe 30. In the illustrated embodiment, each flow control valve 42 is mounted into an orifice 44 having the shape of a slot provided in the top of the manifold pipe 30 (see FIG. 2). Steam enters the valves 42 from the pipe 30 through the slots 44. In the illustrated embodiment, each slot 44 is approximately 1.5 to 2 inches long and has a width of approximately ¼ inch to allow an adequate volume of steam to enter the valves 42. The slots 44 are preferably distributed in even intervals along the entire length of the steam pipe 30. Accordingly, the number of slots 44 with mounted valves 42 provided on a particular steam pipe 30 depends upon the length of the pipe 30 and the width of each valve. Control over the cross-directional moisture distribution is increased as the distance between the slots 44 and associated valves 42 is decreased. To achieve optimum control over the cross-directional moisture distribution, the distance between slots 44 is preferably only a few inches (typically three to six inches).

A baffle 46 may be mounted inside the steam manifold pipe 30 adjacent the steam inlet pipe 32 and between the inlet pipe 32 and the valves 42. The baffle 46 prevents condensate potentially present in the steam from entering the valves 42 located near the steam inlet pipe 32. The baffle 46 spans the diameter of the steam manifold pipe 30 and is preferably approximately ten inches long. A second baffle may be provided inside the steam manifold pipe 30 adjacent its outlet pipe 34 and between the outlet pipe 34 and the valves 42 to allow for reverse installation (i.e., steam flowing into the pipe 30 through the outlet pipe 34). Condensate present in steam entering the steam manifold pipe 30 is deflected by the baffle 46 and collects at the bottom of the pipe, where is it drained out of the pipe 30 through at least one condensate drain orifice 48 provided in the steam manifold pipe 30.

Figure 4:
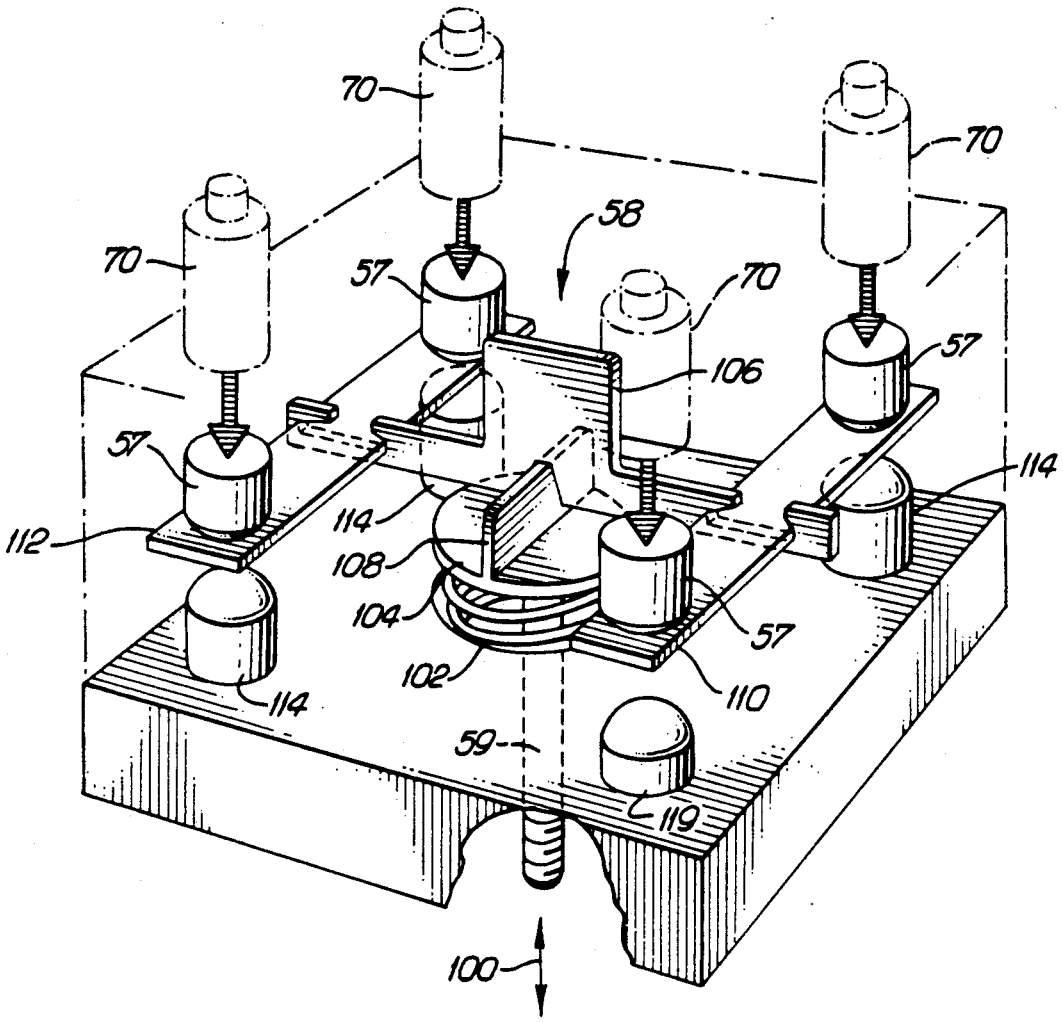
FIG. 4 is a perspective plan view of a portion of the digitally controlled steam valve illustrated in cross-section in FIG. 2.

In the illustrated embodiment of the present invention, as shown in FIGS. 2 and 4, the flow control valves 42 are 16-position digital valves, as disclosed in more detail in commonly assigned, co-pending U.S. Pat. No. application Ser. No. 07/303,540, of Mathew Boissevain, filed Jan. 27, 1989, (now U.S. Pat. No. 5,012,957).

In general, each 16-position digital valve 42 disclosed comprises a poppet valve portion 50 controlled by four solenoid actuated pneumatic linear drivers 52 such as the HS-LS Series Solenoid Valves commercially available from Numatics, Inc. (Michigan). Pressurized air is supplied to the linear drivers 52 by an air hose 54. The air hose 54 channels air from an air regulator 56 (FIG. 3) to the air inlet of each driver 52 at a pressure of approximately 40 psig for activation of pistons 57 associated with the drivers 52. Once a linear driver 52 is activated, air is admitted behind the associated piston 57 and the piston is forced against a lever structure 58. The lever structure 58 in turn contacts the valve stem 59 of the poppet-style valve 50. The number and combination of actuated linear drivers 52 determines the position of the valve stem 59 and thereby the position of the poppet valve 50. The position of the poppet valve 50, in turn, determines the amount of steam flowing toward the paper sheet 12.

FIG. 4 shows the control portion of the 16-position valve 42 in greater detail. One end of the linearly driven valve stem 59 is threaded to receive the poppet valve 50. The stem 59 is free to move in a linear direction indicated by arrows 100. A spring 102 biases the valve 50 closed by engaging a disk 104 mounted to the other end of the valve stem 59. Linear motion is imparted to the valve steam 59 by the movable H-shaped lever structure 58. The H-shaped lever structure 58 includes a center lever 106 pivotally coupled to the valve stem 59. The pivotal coupling may be provided through a vertically extending plate 108 integrally mounted on the disk 104 and a matching wedge-shaped opening in the center lever 106. Resting freely on plate 108, the center driver lever 106 is thus free to pivot through a small angular range.

The H-shaped lever structure 58 further includes second and third levers 110 and 112, respectively, pivotally coupled to the center lever 106 at opposite ends thereof. The center lever 106, second lever 110 and third lever 112 thus form the generally "H"-shaped lever structure 58 when viewed from above. The second lever 110 and third lever 112 are pivotally mounted on center lever 106 which is provided with matching notched recesses in which the levers 110 and 112 rest.

The H-shaped lever structure 58 is driven downward in FIG. 4 in the direction of linear travel by the previously mentioned linear drivers 52. As shown in FIG. 4, the four drivers 52 drive the lever structure 58 through four separate driving positions at the ends of the H-shaped structure. The positioning of the drivers 52 at the ends of the H-shaped structure 58 causes the structure 58 to undergo various pivoting actions in addition to vertical translation upon actuation of various ones of the linear drivers 52.

The stroke of the individual pistons 57 associated with each driver 52 is preferably limited by a matching number of mechanical stops 114. The stops 114 should be of differing heights to provide a varying stroke length for each piston 57, thereby providing the 16 discrete linear positions for the valve stem 59. Selected activation of the linear drivers 52 thus results in 16 distinct combinations of on/off activation positions of the pistons 57. This, in turn, will result in 16 distinct positions of the valve stem 59 and hence, by appropriate selection of the stroke lengths of the pistons 57, and 16 positions may be adjusted, if so desired, to provide equal linear activation steps for the valve stem 59.

A computerized valve control device 80 (FIG. 1) may be provided to selectively activate the various linear drivers 52. To provide a desired moisture distribution on the paper surface, adjustments of the flow control valves 42 may be dynamically made to adjust the amount of steam flowing from each of the poppet valves 50 mounted along the length of the pipe. Additionally, it is desirable to provide access to the poppet valve 50 to allow for manual adjustment of the volume of steam flowing therethrough. In the preferred embodiment, each valve 42 is furthermore provided with a cover 60 to protect the valve components from exposure to condensate which may form on the fluid distribution apparatus or drip from the spray emitted therefrom.

Although the illustrated embodiment of the invention utilizes a 16-position digital flow control valve 42, any type of valve, including a non-digital valve, may be utilized.

Each flow control valve 42 (digital or non-digital) is provided with a nozzle through which steam exits the fluid discharge apparatus 24 and is directed toward the paper sheet 12. Nozzles of various shapes and dimensions may be utilized. In the illustrated embodiment, for example, each valve 42 is provided with a bucket nozzle 62 to convert the relatively high velocity steam jetted from each valve 42 into a low velocity, "lazy" steam. The bucket nozzles 62 of the illustrated embodiment are mounted to the cover 60. Each bucket nozzle 62 comprises a cane-shaped deflector plate 64 mounted adjacent the poppet valve 50, a container 66 (preferably having the shape of a bucket) provided with at least one drain hole 68 in its bottom, and a nozzle portion derived from a second, curved deflector 70 and a third, off-set deflector 72. For convenience, the bucket 66 of the bucket nozzle 62 is provided with a small orifice 74 to allow access to the poppet valve 50 for manual screwdriver adjustments.

Pressurized steam entering the bucket nozzle 62 through the poppet valve 50 jets up against the deflector plate 64, which redirects the steam's flow to the bottom of the bucket 66. Condensate present in the steam collects at the bottom of the bucket 66 and then drains out the drain holes 68. The steam, on the other hand, rises to the top of the bucket 66 and against deflector 70 which, in conjunction with deflector 72, forms the nozzle portion of the bucket nozzle 62. The deflectors 64, 70 and 72 cooperate to decrease the velocity of the steam thereby removing large condensate droplets. The steam "wafts" from the bucket nozzle 62 at a very low velocity in the form of fine mist.

The preferred embodiment as described above, permits precise control over moisture distribution even in settings where steam, recycled for example from other sites in the paper mill, enters the steam pipe 30 at variable pressure and velocity. Thus very minor adjustments needed to level the moisture profile of the relatively dry supercalendered sheet may be made resulting in paper sheets having improved runability and printability.

Other embodiments using steam at lower pressure and/or velocity may use straight nozzles which are not provided with deflector plates. Furthermore, in embodiments wherein the working fluid is atomized water, the nozzle 62 may be replaced by an atomizing spray nozzle. Water supplied to the atomizing spray nozzle is preferably heated to several degrees above the temperature of the paper sheet at that point so that, upon reaching the sheet, the atomized water spray will have the same temperature as the sheet and the temperature profile of the sheet will not be affected. As mentioned above, it is desirable to maintain a constant temperature profile to avoid uncontrollable stretching or shrinking of the sheet while it is being collected or after it has been collected.

Using low velocity steam or an atomized water spray according to the invention, as opposed to a nonatomized water spray or high velocity steam, permits a more even, precisely controlled moisture distribution. Very small adjustments to the moisture profile of the sheet may thus be accomplished.

Again referring to FIG. 1, this figure illustrates two sensors which may be provided downstream of the fluid discharge apparatus 24. In the illustrated system, a gloss sensor 72 and a moisture sensor 78 monitor the gloss profile and moisture content, respectively, of the paper sheet 12. Preferably, the sensors 72 and 78 are of the conventional scanning type which repeatedly scan back and forth across the width of the paper and generate signals corresponding, respectively, to the gloss profile and moisture content profile of the paper sheet 12. Signals from the sensors may then be fed to a suitably programed computerized valve control device 80 which regulates the amount of steam applied by each nozzle 62 as well as by any other steam showers 20 potentially located upstream of the fluid discharge apparatus 24. The appropriate amounts of moisture are thus applied to each section of the paper sheet 12 to achieve uniform gloss and moisture distribution.

In certain situations, it is possible to eliminate the need for a moisture sensor 78. As previously mentioned, the cross-directionally controllable steam showers 20, in conjunction with the calender stack 10, produce the desired finish profile by selectively applying variable amounts of steam to various cross-directional sections of the sheet 12. The increased application of steam to a selected cross-directional sheet section will add a predictable amount of moisture to the sheet 12. Therefore, the signal which controls the opening and closing of the steam shower valves associated with a particular cross-directional sheet section, can also be used to control the valve in the fluid discharge apparatus 24 corresponding to the same cross-directional section. For example, when the valve controller 80 sends a signal to open the valves of the steam showers 20 associated with a particular sheet section, the valve controller 80 can simultaneously send the same signal or a corresponding signal to the valve 42 of the fluid discharge apparatus 24 corresponding to the same sheet section. This signal may be inverted relative to the signal sent to the steam shower 20 or the valve of the fluid discharge apparatus may be constructed such that while the signal incrementally opens the valves of the steam showers 20, the signal simultaneously incrementally closes the corresponding valve in the fluid discharge apparatus 24. Therefore, this embodiment is particularly useful when the sheet entering the calender stack already has a desirable moisture profile. Unlike the previously disclosed embodiment utilizing the moisture sensor 78, this embodiment will be unable to alter the sheet moisture profile since incremental increases in sheet moisture content caused by steam treating the sheet to increase finish are compensated by correspondingly decreased moisture application at the fluid discharge apparatus 24. However, this latter embodiment has the advantage that it does not require a moisture sensor 78. Accordingly, this latter embodiment may have economic advantages in certain situations.

Again referring to FIG. 3, the fluid discharge apparatus 24 of the present invention may be mounted directly to a mount base 82 provided on the calender stack using a yoke 84. The fluid discharge apparatus may be incorporated into any calender stack-collection device arrangement since it functions equally well if mounted at most angles. Thus the invention provides great flexibility as well as a high degree of control over moisture distribution at a low cost. Because moisture is applied by apparatus 24 after the sheet has left the last nip of the calender stack, the surface finish and other paper characteristics will not be affected by its application. In other words, moisture content equalization is decoupled from other paper characteristics. Thus the runability of the paper sheet may be enhanced without loss of printability.

In summary, the present invention includes an apparatus for controlling the moisture content of a calendered material by selectively discharging varying amounts of steam or atomized water toward cross-directional sections of the surface of the calendered material after the material has left the calender stack and before it is taken up on a collection device such as a reel. Built-in valves independently control the steam distribution in the cross-direction. The invention also allows the steam to condense before it contacts the calendered material. A moisture sensor may be used to detect the moisture profile of the paper and a computerized feedback valve control device may be used to selectively activate the valves in accordance with the detected profile.

Several embodiments of the present invention have been illustrated and described. Nevertheless, it will be understood that various additional modifications may be made without departing from the spirit and scope of the invention. For example, the configuration of the slots may be of different sizes than shown, and spaced at different intervals. Also, although the present invention is described primarily with reference to the moisture content of paper, the invention includes controlling, by fluid distribution, moisture profiles of other types of materials. Furthermore, the invention is not restricted for use with supercalenders, but may be used with any calender stack. Working fluids other than steam or atomized water may also be employed and calendered sheet material other than paper used without departing from the principles of the present invention. Accordingly, it is to be understood that the invention is not to be limited by the specific illustrated embodiments, but only by the scope of the appended claims.

We claim:

1. A system for controlling the amount of a first material physically associated with a calendered sheet, the system including a calender stack for calendering the sheet, wherein the calender stack includes a plurality of calender rolls defining at least one nip therebetween, comprising:

a plurality of controllable discharge means for discharging a working fluid, including the first material, toward the surface of the sheet, wherein the discharge means are disposed adjacent the sheet at a location downstream of the last nip of the calender stack and are spaced at intervals along a length of calender rolls for independently varying the amount of working fluid discharged against corresponding cross-directional sections of the sheet.

2. The system of claim 1, wherein the discharge means comprise flow control means for varying the amount of working fluid discharged by the discharge means against corresponding cross-directional sections of the sheet.

3. The system of claim 2, wherein the discharge means are disposed to discharge the working fluid upwardly.

4. The system of claim 2, further comprising:

a. a sensing device for monitoring the amount of the first material associated with the sheet and for producing signals indicative of the monitored amount; and b. controller means, operatively associated with the sensing device and the flow control means, for receiving the signals produced by the sensing device and adjusting the flow control means to vary the discharge of working fluid in response to the signals received.

5. The system of claim 2, wherein the plurality of discharge means substantially span the length of the calender rolls and includes a plurality of nozzles spaced at intervals along the length of the calender rolls, and further wherein the flow control means comprise a plurality of valves for independently varying the amount of working fluid discharged from each nozzle.

6. The system of claim 5, further comprising a fluid supply means for supplying the working fluid to the discharge means in a substantially gaseous phase.

7. The system of claim 6, wherein the discharge means further comprises means for substantially preventing working fluid not in a gaseous phase from being discharged by the nozzles.

8. The system of claim 6, wherein the fluid supply means supplies steam to the discharge means.

9. The system of claim 8, wherein the steam is in a saturated state such that the steam condenses substantially immediately upon discharge from the discharge means.

10. The system of claim 8, further comprising a collection device for collecting the sheet after calendering by the calender stack and a sheet of calenderable material travelling for the at least one nip to the collection device, wherein the discharge means is disposed below the sheet to discharge the steam upwardly toward the surface of the sheet, the discharge means being disposed at a distance below the sheet sufficient to allow the steam to condense after it is discharged from the discharge means and before it contacts the sheet.

11. The system of claim 2, further comprising:

a sensing device for monitoring the amount of the first material associated with the calendered sheet at a plurality of sections across the width of the sheet, the sensing device being adapted to produce signals indicative of the monitored amount of the first material at each section; and a controller, operatively coupled to the sensing device and to the flow control means, wherein the controller is operable to adjust the flow control means to independently vary the amount of working fluid discharged by the discharge means at each section based upon the values of the signals and predetermined amounts of the first material.

12. The system of claim 11, wherein the first material is water.

13. The system of claim 1, wherein the working fluid is water and wherein the discharge means comprises a water atomizer for discharging a fine spray of atomized water.

14. The system of claim 13, further comprising a collection device for collecting the sheet after calendering by the calender stack and a sheet of calenderable material travelling from the at least one nip to the collection device, wherein the fluid supply means supplies water to the water atomizer at a temperature warmer than the temperature of the calendered sheet and wherein the water cools to approximately the same temperature as the sheet before contacting the sheet.

15. A method for controlling the amount of a first material physically associated with a calendered sheet, comprising the steps of:

a. calendering the sheet using a calender stack having at least one nip;

b. discharging an independently controlled amount of a working fluid, including the first material, at and toward each of a plurality of cross-directional sections of the sheet substantially immediately after the sheet has left the last nip of the calender stack; and c. then collecting the calendered sheet on a collection device.

16. The method of claim 15, further comprising the steps of:

a. monitoring the amount of the first material physically associated with the calendered sheet; and b. adjusting the amount of the working fluid discharged toward the calendered sheet in accordance with the monitored and predetermined amounts of the first material.

17. The method of claim 16, wherein the amounts of the first material are monitored at a plurality of sections across the width of the sheet, and the amounts of working fluid discharged toward each section of the sheet are independently adjusted for each section in accordance with the monitored amounts of the first material at each section and a predetermined amount of the first material for each section.

18. The method of claim 15, wherein the calendering, discharging the collecting steps are conducted on a supercalender machine.

19. The method of claim 15, wherein the first material includes water.

20. A system for controlling the moisture content of a calendered paper sheet, comprising:

a. a calender stack including a plurality of calender rolls defining at least one nip therebetween;

b. a collection device for collecting the calendered paper sheet;

c. a plurality of water discharge means disposed adjacent the sheet at a location downstream of the last nip of the calender stack and between the calender stack and the collection device, for discharging water to a corresponding plurality of cross-directional sections of the calendered sheet;

d. A moisture sensor, disposed adjacent the sheet, wherein the moisture sensor is operable to generate signals indicative of the moisture content of each cross-direction section; and e. a controller, operatively coupled to the water discharge means and to the moisture sensor, wherein the controller is operative to independently control the amount of water discharge by the water discharge means to each cross-directional section based upon the signals indicative of the sheet moisture content at the corresponding cross-directional sections.

21. The system of claim 20, wherein the water discharge means includes a plurality of water atomizers spaced at intervals across the sheet and operable to discharge sprays of atomized water toward each adjacent cross-directional section.

22. The system of claim 21, wherein the water discharge means includes a plurality of steam nozzles spaced at intervals across the sheet and operable to discharge jets of steam toward each adjacent cross-directional section.

* * * * *